US011485454B1

(12) United States Patent
Sasiela

(10) Patent No.: US 11,485,454 B1
(45) Date of Patent: Nov. 1, 2022

(54) APPARATUS AND METHOD TO CONFIRM ANCHOR HOLDING STATUS

(71) Applicant: Ronald Sasiela, Los Angeles, CA (US)

(72) Inventor: Ronald Sasiela, Los Angeles, CA (US)

( * ) Notice: Subject to any disclaimer, the term of this patent is extended or adjusted under 35 U.S.C. 154(b) by 0 days.

(21) Appl. No.: 17/566,317

(22) Filed: Dec. 30, 2021

(51) Int. Cl.
*B63B 21/26* (2006.01)
*B63B 22/20* (2006.01)
*B63B 22/04* (2006.01)

(52) U.S. Cl.
CPC ..... *B63B 21/26* (2013.01); *B63B 22/04* (2013.01); *B63B 22/20* (2013.01)

(58) Field of Classification Search
CPC ..... B63B 21/24; B63B 21/26; B63B 21/46; B63B 21/50; B63B 22/04; B63B 22/20
USPC ..... 114/293, 294, 297, 299; 441/28
See application file for complete search history.

(56) References Cited

U.S. PATENT DOCUMENTS 5,766,049 A * 6/1998 Letourneau ..... B63B 22/18 441/16
9,708,036 B2 * 7/2017 Ries ..... B63B 22/00

* cited by examiner

*Primary Examiner* — Daniel V Venne

(57) ABSTRACT

An anchor assembly for discerning if an anchor has securely engaged with the seabed, having a float with a length of line below no more than twice the distance from the water's surface to the seabed. The float includes a redirection element that allows the line to support a ballast weight via a descending portion of the line and an ascending portion that is secured to an anchor. The volume of the float and ballast weight are selected such that the float remains visibly buoyant when the anchor is stationary, yet becomes wholly or partially submerged when the anchor is in motion with respect to the seabed surface.

20 Claims, 4 Drawing Sheets

APPARATUS AND METHOD TO CONFIRM ANCHOR HOLDING STATUS

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

Technical Field

Embodiments of the present description relate to an anchor setting apparatus and method for boats, and more particularly an apparatus and method for indicating whether an anchor is properly set or dragging.

Background Discussion

The field of boat anchoring can be traced back thousands of years, beginning perhaps with a rock wrapped with twine and tossed over the side. Modern anchors include strong and lightweight advanced designs that are intended to bury themselves quickly and deeply.

However, regardless of the aforementioned advancements, existing anchor line configurations suffer from the uncertainty of confirming when and if an anchor is being adequately "set", i.e. when the anchor has engaged with a seabed to the point where it is stationary or holding with the seabed floor in spite of loading applied to the anchor applied to dislodge it (e.g. from the line/boat it is attached to). Using existing systems, the exact location after being deployed or how to readily recognize when it is dragging vs. firmly engaged with the bottom can often still be a mystery to the user. A dragging anchor can lead to peril, especially when the wind and sea conditions build, and if the vessel is proximate to a lee shore or other danger.

A trip line, which may also be referred to as an "anchor buoy", employs a buoy attached to the crown or other location of the anchor by a rope. The length of the line is generally set to a depth equal to the depth of water at high tide. The trip line is intended to mark the spot where your anchor is set, but generally does not indicate whether the anchor is dragging, and can lead to problems with changing tides.

U.S. Pat. No. 4,808,133 describes a marker buoy with self-retracting line. It discusses a watertight reeling mechanism designed to keep an anchor locating float over the anchor and allows that the float remain at least partially above water.

U.S. Pat. No. 6,332,423 is directed to a marine anchor and the anchor's unknown set depending on the sea bottom characteristics, e. g., sand, clay, mud, etc. A hole in the anchor is provided to connect a trip line, but fails to recognize its value to provide evidence of whether the anchor has set in the different mentioned seabed types.

Jim Buoy Anchor Trip Line with Marker Buoy provides for a float marker with a coiled line around it. It is fastened to the anchor, and they are tossed collectively into the water when the anchor is being lowered. The buoy rises to the surface, uncoiling the line which is then cleated to the buoy to mark the anchor's location. With the now fixed length of line between the floating marker buoy and anchor, it is possible that the float will drift away from over the anchor with a lower tide or become and remain completely submerged below the water's surface as the tide rises or waves pass beneath it. If the anchor drags, the vertical column position of the buoy relative to the water's surface will remain the same since it is intended to continually remain floating and visible.

SUMMARY OF THE DISCLOSURE

An aspect of the present description is a system and method which balances the buoyancy of a trip line anchor float with a ballast weight suspended below the float such that when the anchor is being set by the typical action of the vessel's reverse propulsion—either engine, sails or other forces—the float will wholly or partially submerge while dragging on the seabed, until such time that the anchor has taken a firm hold with the seabed. At that time, the previously submerged float will again reappear, returning to the water's surface for viewing from the vessel and by others, thus confirming a successfully set anchor. The technology of the present description is robust and does not rely on any GPS, mechanical (other than an optional single pulley), or electronic means to function, but rather simply an application of a precise balance of buoyancy, hydrodynamic and gravitational forces to exhibit its beneficial functions.

After deployment, and confirming that the anchor has set, the float's presence at the surface continues to assist to provide the vessel's skipper with their swing radius, independent of tide surge, waves and other such depth altering factors. This visual information is useful to avoid contact with surrounding vessels, shoreline rocks, or additional such objects.

Furthermore, if the anchor were to break free from its seabed hold and allow the vessel to drift due to changing wind, wave and/or current forces, or seabed adhesion issues, the float could again, continually and repeatedly display its submerging behavior and provide a visual warning alert notice to the skipper.

BRIEF DESCRIPTION OF THE SEVERAL VIEWS OF THE DRAWING(S)

The technology described herein will be more fully understood by reference to the following drawings which are for illustrative purposes only:

Figure 3:
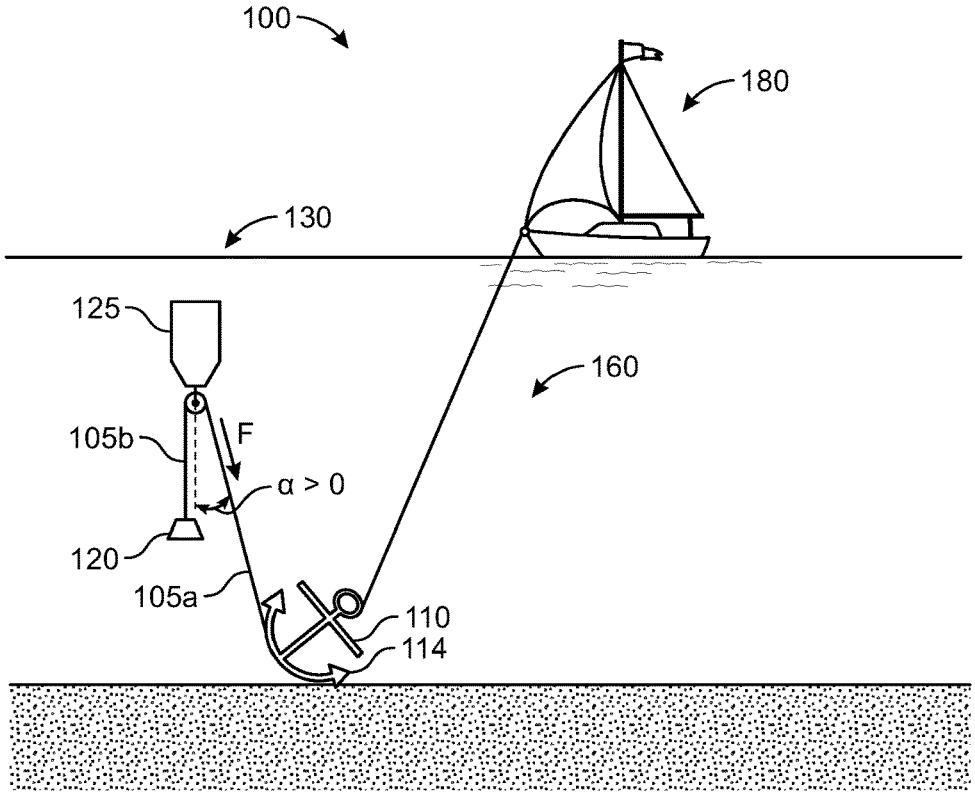

FIG. 3 shows a high-level schematic illustration of the anchor setting system of FIG. 1 with the boat speed >0 kts, with its engine in reverse, in the process of setting the anchor, a scope of greater than 1:1, and the trip line float being drawn below the surface of the water and before the anchor sets while the anchor is skipping along the seabed's surface in accordance with the present description.

Figure 4:
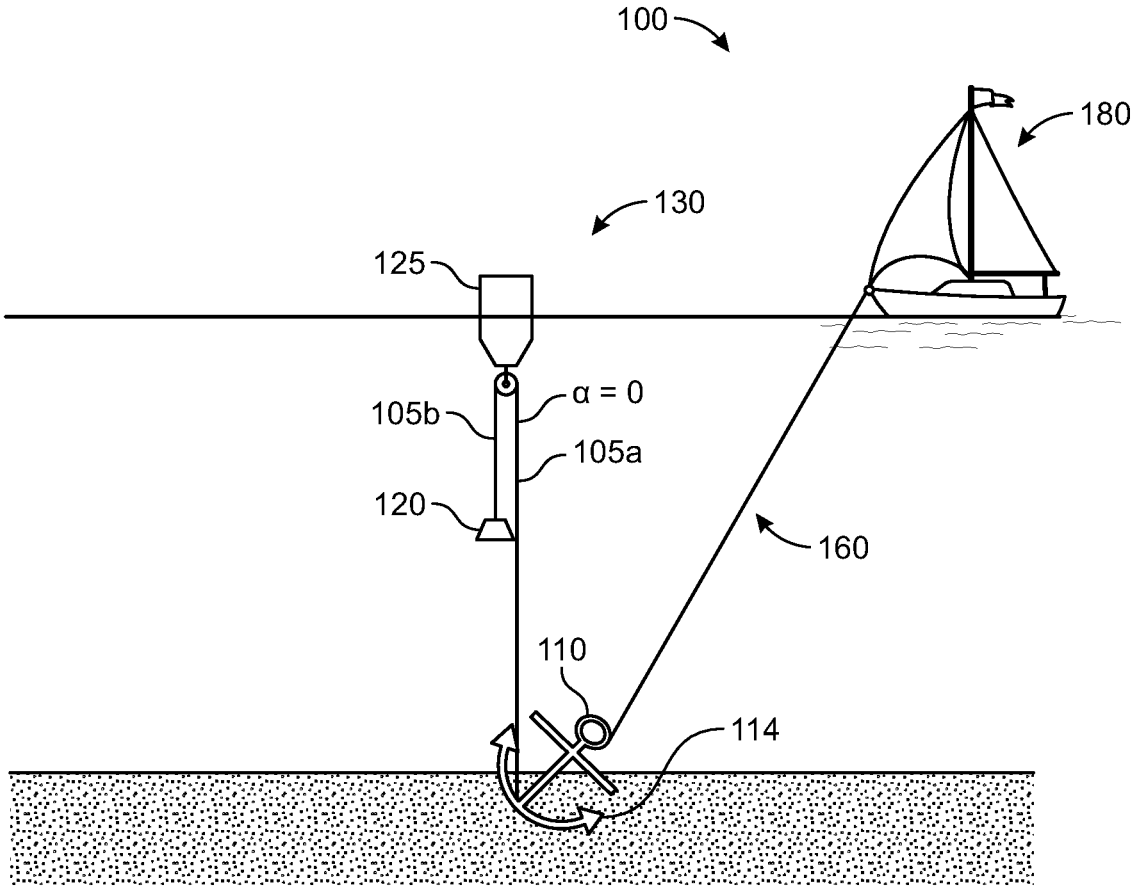

FIG. 4 shows a high-level schematic illustration of the anchor setting system of FIG. 1 with the boat, speed at 0 kts, with its anchor successfully set below the seabed's surface, a scope much greater than 1:1 and the trip line float now visible again above the surface of the water.

Figure 5:
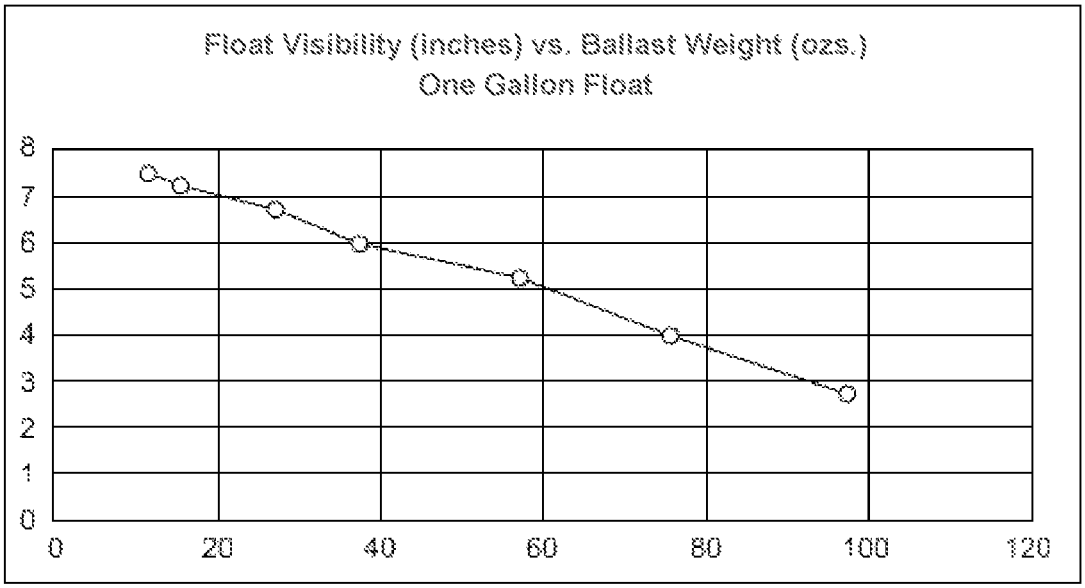

FIG. 5 is a chart illustrating a typical relationship, and influence between, the ballast weight of the trip line and the visibility of a common gallon jug float.

Figure 6:
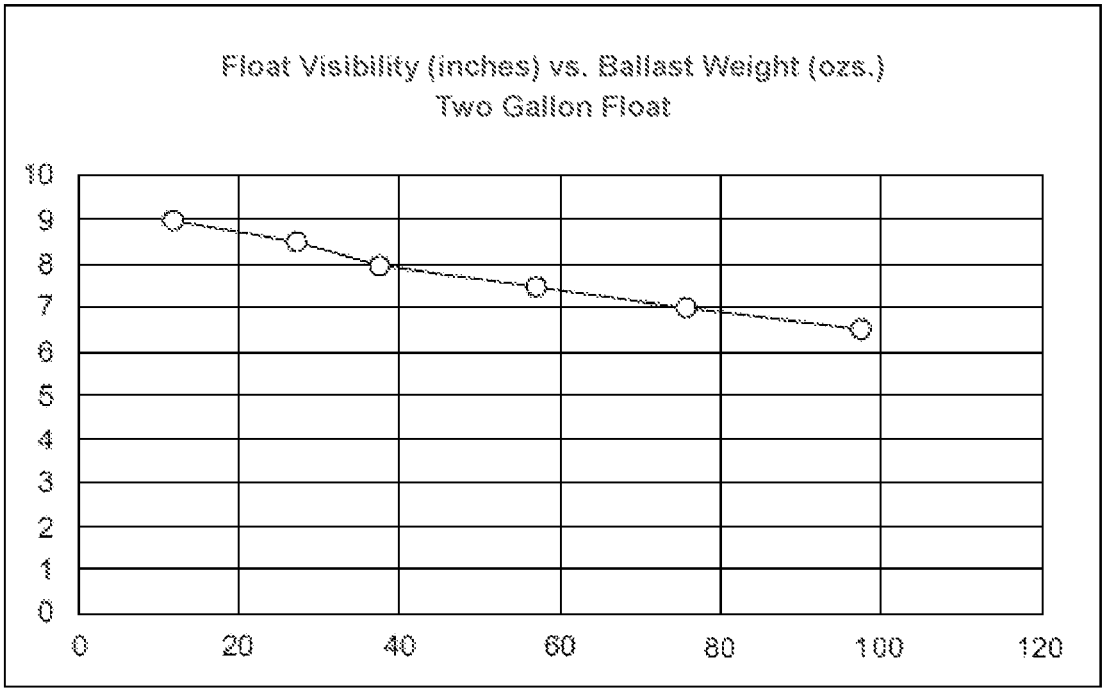

FIG. 6 is a chart illustrating a typical relationship, and influence between, the ballast weight of the trip line and the visibility of a common approximate two-gallon jug float.

DETAILED DESCRIPTION

Figure 1:
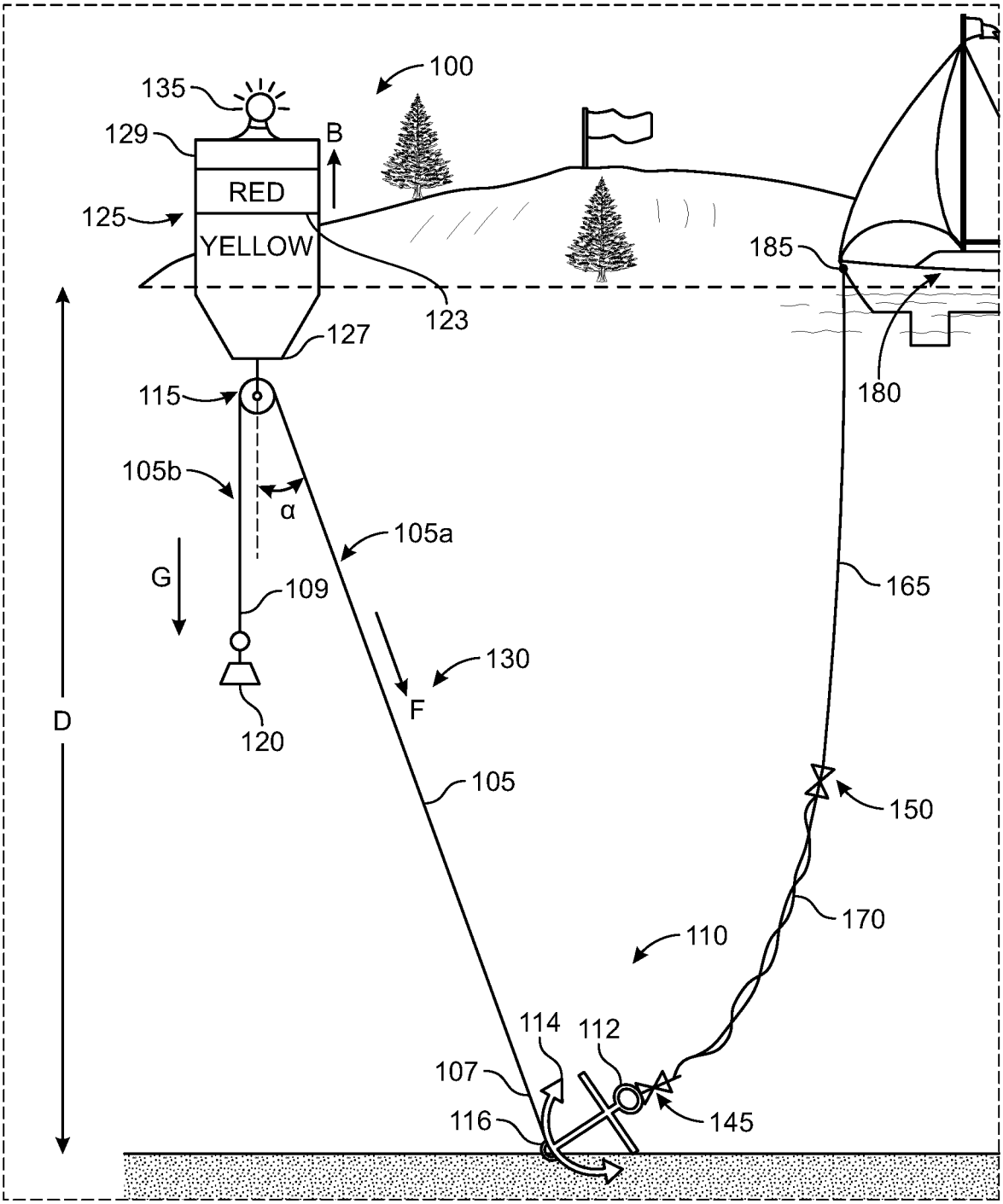
FIG. 1 is a schematic diagram of an anchor setting system in accordance with the present description.

FIG. 1 an anchor setting system 100 for indication of anchoring status of a vessel 180 with a seabed surface in accordance with the present description. Anchor setting system 100 includes a trip line float assembly 130 comprising a location float 125, ballast weight 120, and trip line 105. The trip line float assembly 130 is shown in FIG. 1 coupled to a first attachment point 116 of anchor 110 (e.g. via a loop 116 at the crown of the anchor 110 that allows reception/attachment of the first end 107 of the trip line 105). Anchor 110 also comprises an anchor head 112 that forms another attachment point for reception/coupling of an anchor rode 160 (FIG. 2) that connects the anchor 110 to a vessel 180. In the embodiment of the anchor setting system 100 shown in FIG. 1, the anchor 110 may be specifically configured to have attachment points 116/112 that are amenable to coupling to both the trip line float assembly 130 and anchor rode 160 at spaced apart locations (112/116). It is also appreciated that trip line float assembly 130 may also be implemented as a stand-alone device that is configured for coupling or use with numerous types of existing anchors and/or rode assemblies.

While the vessel is shown in FIG. 1 as a sailboat, it is appreciated that for the purposes of this description, a "vessel" may comprise any number of floating platforms or vehicles, for example, boats as small as rowboats, to motorboats, cruise ships, barges, cargo vessels, tankers, etc. Furthermore, "seabed" is broadly defined to mean any submerged surface, whether being an ocean floor, lake or river bed, or other body of water. Furthermore, the components listed in FIG. 1 through FIG. 4 are detailed for schematic purposes only, and are not true to scale or exact orientation.

The trip line 105 may be made of typical marine cordage, such as nylon, Dacron, floatable polypropylene, wire, or other natural or manmade material. In a preferred embodiment, the tensile strength of the trip line 105 is sufficient to withstand the force of retrieving the anchor 110 (i.e. "tripping") and any chain attached to it, in the event that the anchor 110 became lodged in a seabed obstruction, such as rocks, cables, a pipeline, or debris.

Anchor rode 160 may comprise a chain portion 170 at its bottom extent and coupling to head 112 of the anchor 110, along with a fiber portion 165 at its upper extent back to the attachment point 185 of vessel 180. Such chain portion 170 helps with providing a more horizontal pulling force to keep the anchor 110 set. It may also be advantageous for the anchor rode 160 to be fitted with one or more swivels 145 and 150 between chain portion 170 and anchor 110 and chain portion 170 and fiber portion 165, respectively, as illustrated in "A Boater's Guide to the Federal Requirements for Recreational Boats", published by the U. S. Department of Homeland Security—the parent agency of the U. S. Coast Guard, U. S. Government Printing Office: 2010-361-210, and incorporated herein by reference. The use of a swivel 150 helps to remove chain 170 and rope 165 twist, which can inadvertently contribute to wrapping of the trip line 105 around the anchor 110 when it is lowered to or retrieved from the seabed. Such wrapping would undesirably result in effectively shortening the available length of trip line 105. Instead of or in combination with swivel 150, swivel 145 may be positioned at the shank/head 112 of the anchor 110 as recommended by windlass manufacturers. Such swivels 145/150 also serve to reduce the risk of a rope cockle by relieving the rope's twist stress.

Trip line float assembly 130 generally comprises a trip line 105 that is attached at a first end 107 to the anchor 110 (e.g. at crown attachment point 107) and at a second end 109 to ballast weight 120, while also passing through a line redirection element 115 on the location float 125 between the first end 107 and second end 109. In one embodiment, the redirection element 115 comprises a pulley 115 to minimize friction and/or abrasion. However, it is appreciated that redirection element 115 may comprise any number of mechanisms capable of redirecting or reversing the trip line 105. For example, the redirection element 115 may comprise a shackle, loop of line, or similar device that is coupled to bottom portion 127 of the location float 125 (or runs through the handle of a location float 125 in the form of a jug or like floatation element).

As seen in FIG. 1, the trip line 105, with assistance of the redirection element, 115 essentially reverses direction and can be understood to have two variable-length portions during various points in operation: an ascending portion 105*a* spanning from the anchor 110 (or first end 107) to the redirection element/pulley 115; and a descending portion 105*b* spanning from the pulley 115 down to the ballast weight 120 or second end 109.

The preferred maximum length of whole trip line 105 is approximately twice the distance D (i.e., depth) from the low tide water's surface to the seabed, and preferably greater than distance D. Such distance D can be easily predetermined from several sources, such as published NOAA nautical charts, also now available in electronic form, actual depth sounder values from the vessel's transducer-sonar, use of a lead line, or like methods. Such a length D allows the location float 125 to be essentially plumb above the anchor 110 under all tide conditions, and to constantly adjust its level D to account for changes in tide, wave and swell activity, and wind effects.

If length of the trip line 105 is less than distance D, the location float 125 will always be below the surface of the water and undesirably not visible from the vessel 180 or elsewhere. Conversely, if the length of the trip line 105 is greater than twice the distance D, then the ballast weight 120 will reside directly on the seabed, allowing the location float 125 to randomly drift with the wind or current and losing the feature of accurately describing the location of the anchor 110 below. Additionally, an excessively long trip line 105 may allow the ballast weight 120 to become entangled in the anchor 110, or its rode 160, or drift to the propeller of the vessel where it could foul itself.

In one embodiment of the anchor setting system 100 presented herein, the collective ballast weight 120 is sized/weighted with a mass in relation to the buoyancy force B exerted by location float 125 so as to continually exert a known, unobstructed downward gravitational force G intended to maintain trip line 105 taut, and keep the location float 125 in a nearly vertical posture.

Depending on the anchoring status of the vessel 180, the trip line 105 will have an angular orientation, or variable angle of deflection α, that is measured as a function of the angle of ascending portion 105*a* and an imaginary vertical plumb line dropping from the center, fulcrum point of the pulley or redirection element 115. Deflection angle α will be essentially zero when the anchor 110 is set (i.e., not "dragging") and/or when the anchor 110 is not moving in relation to the seabed. However, when the anchor 110 drags, the ascending portion 105*a* will be drawn out of plumb by the horizontal movement of the anchor 110 beneath it, thus creating an inverted V shape using the gravitational plumb or descending portion 105*b* to the ballast weight 120 as the other arm of that inverted V to arrive at the angle of deflection angle α. For purposes of this description, "drag" or "dragging" is defined to describe a condition where the anchor 110 is translating or moving with respect to the seabed surface. For example, the anchor 110 may be "skipping", or momentarily in states of contact and elevation above the seabed surface, or wholly translating transverse to the seabed surface while above the seabed surface.

In a preferred configuration, the length of the entire trip line 105 (ascending portion 105*a* and descending portion 105*b*) is sized so as to keep the ballast weight 120 in a hanging or suspended state above the seabed and below the pulley 115. I.e. based on the depth of the water, trip line 105 will have a maximum length such that the ballast weight 120 does not touch the seabed and a minimum length that allows the anchor 110 to rest on the seabed without the line redirection element 115 forming a hard stop with the ballast weight (total length being less than water depth so as not to have a descending portion 105*b*).

In preferred embodiments, the mass of the ballast weight 120 (affecting force G) is selected so that it assures the location float 125 is essentially projecting vertically from the water's surface and not laying on its side. Such a latter condition would make it less observable to the anchoring vessel and others, especially viewed from a further distance. Conversely, ballast weight 120 must not be so heavy that it causes the location float 125 to be significantly submerged when being first deployed. That condition would also contribute to reduced visibility of the location float, especially if the trip line 105 was deployed when significant wave action was present. In that situation, the sighting of the float 125 would be periodically lost as it descended into the trough of a wave or swell. The sensitivity of the location float 125 to submerging can be increased by increasing the ballast weight 120.

It is advantageous to maximize the visibility of location float 125 above the water level, thus allowing it to be viewed both by the anchoring vessel 180 as well as other vessels in the vicinity, along with arriving rescue craft that may be summoned. To that end, location float 125 can be provided with a variable color scheme (e.g. red band 123 toward the upper end 129 of the location float 125 and yellow bottom toward bottom end 127). The bright colors make the location float 125 easier to spot and be avoided by another passing watercraft. A yellow float with a red band around it, for example, would satisfy such contrast to the usually blue or green water's color. Furthermore, the location float 125 could be outfitted with a solar powered light 135 or reflective tape (not shown), which would allow for such identification in conditions of reduced visibility and between sunset and sunrise.

While the design of the location float 125 could be such that it had a broad, ballasted base itself and a narrow upper extension, the sighting of the float could be correspondingly diminished with distance between the vessel 180 and the float 125 due to its reduced cross-sectional area being viewed. Affixing a flag (not shown) at the top of any such narrow upper extension enhances its visibility but can cause it to tilt to leeward in strong winds and even undesirably knocked down close to the water's surface thus negating its purpose.

Space on boats is at a premium, so having equipment that is conservative in volume, yet still highly functional is advantageous. While FIG. 1 illustrates a location float 125 as a typical ridged gallon plastic jug, it is understood that the location float 125 can be made of a collapsible and/or inflatable device which would occupy less room on the boat.

Figure 2:
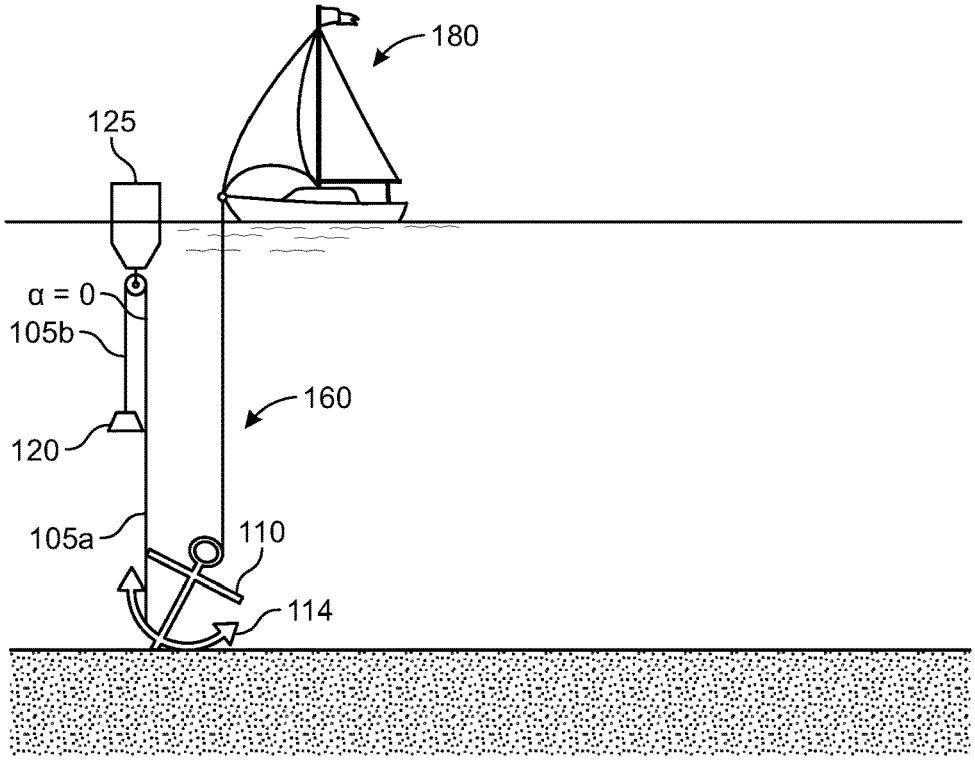
FIG. 2 shows a high-level schematic illustration of the anchor setting system of FIG. 1 with a boat speed at 0 kts, with its anchor just lowered to the seabed at a scope of about 1:1—rode length to depth—with the trip line float assembly secured to the crown of the anchor and the trip line float at the water surface in accordance with the present description.

FIG. 2 through FIG. 4 illustrate a method of setting an anchor utilizing the anchor setting system of FIG. 1 for anchoring status according to the presented technology.

Referring to the schematic diagram of FIG. 2, when the vessel is at rest and not dragging its anchor 110, for example when the anchor setting system 100 (including a trip line float assembly 130 and anchor 110/rode 160) is lowered and comes into contact with the seabed such that the boat speed is essentially 0 kts (or close thereto) and there is no deflection of ascending portion 105*a* from vertical (rode scope=1:1). In this part of the process, the ascending portion 105*a* down from the location float 125 to the anchor typically has a deflection angle α=0°. Calmer surface conditions are typically selected when a skipper seeks an anchoring location, preferably in a sheltered harbor, bay, or cove.

Referring to the schematic diagram of FIG. 3, a schematic diagram is shown detailing the anchor setting system 100 (e.g. anchor rode 160, the anchor 110, trip line float assembly 130 and trip line 105, etc.) while the vessel 180 and anchor are moving in relation to the seabed to set the anchor 110. The anchor 110 is skipping or dragging across the seabed, attempting to dig arm 114 of the anchor 110 into the seabed while the vessel 180 is moving astern at speed >0 kts to cause that desired result. While this is all occurring, the ascending portion 105*a* of the trip line 105 is drawn away from its prior vertical orientation (deflection angle α=0°) and is now being deflected and a non-zero or increasing angle (deflection angle α>0°). The increasing deflection angle α and/or force F along the ascending portion 105*a* (along with the force G from the ballast weight 120) counteract the buoyancy force B of location float 125 to cause the location float 125 to submerge or dive under the surface of the water (see also FIG. 1). This occurrence provides the skipper or crewman a visual indication of a "dragging anchor" condition with respect to anchoring status.

FIG. 4 shows the anchor 110 now having been well buried into the seabed, the vessel is now prevented from moving further astern, and vessel 180 speed returns back to 0 kts, by the anchor 110 holding power, which in turn modifies the force F along the ascending portion 105*a* in relation to the buoyancy force B of location float 125 such that the deflection angle α decreases back toward the 1:1 rode scope condition (i.e., deflection angle α=0°). This in turn allows the location float 125 to ascend back toward and "popping" back above the water surface (its prior FIG. orientation/visibility). This occurrence provides the skipper or crewman a visual indication of an "anchor set" condition with respect to anchoring status, thus providing visual confirmation of the desired successful set of the anchor 110.

When utilizing location float 125, equilibrium is established between the upward buoyancy force B and the downward gravitational force G (and accompanying force on ascending portion 105*a*). The gravitational force G may include the combined weight of the float 125, the weight of the trip line 105 descending portion 105*b*, the ballast weight 120, and any additional hardware, such as a pulley 115, fasteners, etc. If the trip line 105 is of a buoyant type, such as synthetic polypropylene, then it too would contribute to the buoyancy force B rather than the gravitational force G.

To further expand on this equilibrium, a series of experiments were conducted to determine what would be the optimum ballast weight 120 for two typical size location floats 125.

The first was a common plastic gallon jug, as illustrated in FIG. 1. Results for this test are illustrated in the chart of FIG. 5. The study shows that the gallon float initially extended 7½" vertically above the surface of the water with 16 oz. of ballast weight 120. It would be readily visible from a recreational boat anchored in 20' of water and using a 7:1 scope 140' away. However, when the ballast weight 120 was gradually increased, its visibility above the water decreased to less than 3" with a ballast weight of about 95 oz. Advantageously, heavier ballast weight can cause the float to submerge earlier than otherwise and enhance its responsiveness to slower anchor 110 dragging speeds.

The study was repeated substituting the one-gallon jug with an approximate two-gallon volume jug. Results from this study are shown in the chart of FIG. 6. A similar relationship was discovered with a higher 9" of the jug visible above the waterline with the same initial 16 oz. ballast weight, decreasing to 6½" visible when just under a 100 oz. ballast weight was utilized.

The use of the anchor setting system 100 presented herein is not restricted to recreational boats 180, but finds application for larger vessels and ships, as well. For example, knowing the location of a cargo ship's anchor and confirming that it is not dragging is a benefit for a vessel to avoid anchoring near an offshore oil pipeline. Dragging of the anchor 110 from its assigned position, due to wind, current, seabed changes or other factors can be immediately recognized by a stationed crew member at the bow otherwise monitored, for example, from the helm with a video camera trained on the location float 125. The crew member would alert the skipper to take immediate corrective action and avert a possible environmental oil leak disaster. With the increased use of large offshore wind generators, being able to assure an anchored vessel is not dragging is advantageous to avoid damaging those buried electrical cables.

It is a feature of the anchor setting system 100 presented herein that it does not rely on or become negatively influenced by the seabed characteristics. The ability of how quickly and how well an anchor 110 sets is influenced by many factors such as the anchor's weight and design, amount of scope, yawing, helmsman's technique, and boat freeboard. Often overlooked are the dilatant characteristics of the seabed and its effect on the anchor's penetration through it and subsequent propensity to lose that grip, especially during yawing. If the anchor started to drag due to these factors or others and the anchor broke free from the bottom and started to drift downwind or down-current, the disappearance of the float 125 could be again observed. Such float disappearance can occur at drift speeds of 1 kt or less depending on the ballast weight 120, length of trip line 105 and speed of the reversing vessel 180.

With this description, those skilled in the art now understand the visibility parameters, trade-offs and ballast weight/buoyancy balance that is possible to utilize the system and methods of the present technology.

From the description herein, it will be appreciated that the present disclosure encompasses multiple embodiments which include, but are not limited to, the following:

1. An anchor setting system for a vessel in a body of water, comprising: an anchor configured for engaging with a seabed surface of the body of water; an anchor rode configured for coupling the anchor to an attachment point on the vessel; a trip line float assembly coupled to the anchor; the trip line float assembly comprising a trip line having a first end configured for attachment to the anchor and a second end configured to attached to a ballast weight; a location float coupled to the trip line at a variable location between the first end and second end; the location float comprising a redirection element through which the trip line is free to pass through; wherein the trip line and ballast weight are configured such that the ballast weight hangs under the location float at a location suspended above the seabed surface to exert a downward force on the location float; and wherein the trip line float assembly is configured such that the location float at least partially submerges below a surface of the body of water when the anchor is translating in a direction transverse to the seabed surface to indicate a non-set condition of the anchor.

2. The system, apparatus or method of any of the preceding or subsequent embodiments, wherein one or more of a mass of the ballast weight and volume of the location float are sized so that at least a portion of the location float remains elevated above the water surface when the anchor is in a set or stationary position on the seabed surface, yet becomes submerged under the water surface when the anchor is translating or moving in relation to the seabed surface.

3. The system, apparatus or method of any of the preceding or subsequent embodiments, wherein the trip line has a maximum length of twice a depth from the water surface to the seabed surface, and a minimum length equal to said depth.

4. The system, apparatus or method of any of the preceding or subsequent embodiments, wherein the redirection element comprises a pulley.

5. The system, apparatus or method of any of the preceding or subsequent embodiments, wherein the redirection element comprises a loop.

6. The system, apparatus or method of any of the preceding or subsequent embodiments, wherein the redirection element is disposed at a bottom location of the location float.

7. The system, apparatus or method of any of the preceding or subsequent embodiments: wherein the trip line has a length such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

8. The system, apparatus or method of any of the preceding or subsequent embodiments, wherein the anchor has a first attachment point for coupling to the anchor rode and a second attachment loop distanced away from the first attachment point for coupling to the trip line.

9. An apparatus for indicating a setting condition of an anchor of a vessel in a body of water, comprising: a trip line having a first end configured for attachment to the anchor and a second end configured to attached to a ballast weight, the anchor configured for engaging with a seabed surface of the body of water; a location float coupled to the trip line at a variable location between the first end and second end; the location float comprising a redirection element through which the trip line is free to pass through; wherein the trip line and ballast weight are configured such that the ballast weight hangs under the location float at a location suspended above the seabed surface to exert a downward force on the location float; and wherein the trip line float assembly is configured such that the location float at least partially submerges below a surface of the body of water when the anchor is translating in a direction transverse to the seabed surface to indicate a non-set condition of the anchor.

10. The system, apparatus or method of any of the preceding or subsequent embodiments, wherein one or more of a mass of the ballast weight and volume of the location float are sized so that at least a portion of the location float remains elevated above the water surface when the anchor is in a set or stationary position on the seabed surface, yet becomes submerged under the water surface when the anchor is translating or moving in relation to the seabed surface.

11. The system, apparatus or method of any of the preceding or subsequent embodiments, wherein the trip line has a maximum length of twice a depth from the water surface to the seabed surface, and a minimum length equal to said depth.

12. The system, apparatus or method of any of the preceding or subsequent embodiments, wherein the redirection element comprises a pulley.

13. The system, apparatus or method of any of the preceding or subsequent embodiments, wherein the redirection element comprises a loop.

14. The system, apparatus or method of any of the preceding or subsequent embodiments, wherein the redirection element is disposed at a bottom location of the location float.

15. The system, apparatus or method of any of the preceding or subsequent embodiments: wherein the trip line has a length such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

16. A method for setting an anchor for a vessel in a body of water, comprising: coupling a first end of a trip line to a ballast weight and a second end of the trip line to an anchor configured for engaging with a seabed surface of the body of water, the anchor coupled to the vessel via an anchor rode; the location float being coupled to the trip line at a variable location between the first end and second end and comprising a redirection element through which the trip line is free to pass through; dropping the anchor and trip line into the body of water such that the anchor sinks to contact the seabed surface; suspending the ballast weight below the location float at a location above the seabed surface to exert a downward force on the location float; and moving the vessel to cause translation of the anchor in a direction transverse to the seabed surface, such motion of the anchor causing one or more of a force or orientation of the trip line to cause the location float to at least partially submerge below a surface of the body of water to indicate a non-set condition of the anchor.

17. The system, apparatus or method of any of the preceding or subsequent embodiments, further comprising: engaging the anchor with a seabed surface such that motion of the anchor with respect to the seabed surface is ceased; wherein cessation of motion of said anchor allows the location float to return to the water surface to indicate that the anchor has been set.

18. The system, apparatus or method of any of the preceding or subsequent embodiments, further comprising: sizing one or more of a mass of the ballast weight and volume of the location float so that at least a portion of the location float remains elevated above the water surface when the anchor is in a set or stationary position on the seabed surface, yet becomes submerged under the water surface when the anchor is translating or moving in relation to the seabed surface.

19. The system, apparatus or method of any of the preceding or subsequent embodiments, further comprising: setting a length of the trip line such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

20. The system, apparatus or method of any of the preceding or subsequent embodiments, wherein the trip line is sized to have a maximum length of twice a depth from the water surface to the seabed surface, and a minimum length equal to said depth.

21. An anchor assembly for discerning if an anchor has securely engaged with the seabed, comprising: a float with a length of line below no more than twice the distance from the water's surface to the seabed; and a securing feature of the float that allows the line to support a ballast weight at one descending free end that causes the line to be taut, the line passing over means to reverse its direction to a further portion of the line that descends to and is secured to an anchor, such that the volume of the float is in balance with the ballast weight allowing the float to remain visibly buoyant when the anchor is stationary once set, yet becomes wholly or partially submerged when a horizontal force is applied to the anchor by a vessel at the surface, that causes said anchor to travel in relation to the seabed if not adequately set.

22. The system, apparatus or method of any of the preceding or subsequent embodiments wherein the means to reverse direction of the ascending portion to the descending portion is a pulley.

23. The system, apparatus or method of any of the preceding or subsequent embodiments wherein the ballast weight is adequate to maintain the trip line taut, maintain the float in a nearly vertical posture while not excessively heavy to cause the float to be submerged while the boat is at zero speed over the anchor.

24. A method for discerning if an anchor is securely engaged with the seabed, comprising: deploying a float at the surface with a pulley beneath, attached to the float is a line, one end of which is connected to an anchor—the ascending portion, the other free end—the descending portion, having a ballast weight which keeps the line taut and centers the float over the anchor, wherein the angle formed between the two lines is essentially zero except when the anchor is moving relative to the seabed.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural, chemical, and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

In addition to any other claims, the applicant(s)/inventor(s) claim each and every embodiment of the technology described herein, as well as any aspect, component, or element of any embodiment described herein, and any combination of aspects, components or elements of any embodiment described herein.

What is claimed is:

1. An anchor setting system for a vessel in a body of water, comprising:

an anchor configured for engaging with a seabed surface of the body of water;

an anchor rode configured for coupling the anchor to an attachment point on the vessel;

a trip line float assembly coupled to the anchor;

the trip line float assembly comprising a trip line having a first end configured for attachment to the anchor and a second end configured to attached to a ballast weight;

a location float coupled to the trip line at a variable location between the first end and second end;

the location float comprising a redirection element through which the trip line is free to pass through;

wherein the trip line and ballast weight are configured such that the ballast weight hangs under the location float at a location suspended above the seabed surface to exert a downward force on the location float; and wherein the trip line float assembly is configured such that the location float at least partially submerges below a surface of the body of water when the anchor is translating in a direction transverse to the seabed surface to indicate a non-set condition of the anchor.

2. The anchor setting system of claim 1, wherein one or more of a mass of the ballast weight and volume of the location float are sized so that at least a portion of the location float remains elevated above the water surface when the anchor is in a set or stationary position on the seabed surface, yet becomes submerged under the water surface when the anchor is translating or moving in relation to the seabed surface.

3. The anchor setting system of claim 1, wherein the trip line has a maximum length of twice a depth from the water surface to the seabed surface, and a minimum length equal to said depth.

4. The anchor setting system of claim 1, wherein the redirection element comprises a pulley.

5. The anchor setting system of claim 1, wherein the redirection element comprises a loop.

6. The anchor setting system of claim 4, wherein the redirection element is disposed at a bottom location of the location float.

7. The anchor setting system of claim 1:

wherein the trip line has a length such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

8. The anchor setting system of claim 1, wherein the anchor has a first attachment loop for coupling to the anchor rode and a second attachment loop distanced away from the first attachment loop for coupling to the trip line.

9. An apparatus for indicating a setting condition of an anchor of a vessel in a body of water, comprising:

a trip line having a first end configured for attachment to the anchor and a second end configured to attached to a ballast weight, the anchor configured for engaging with a seabed surface of the body of water;

a location float coupled to the trip line at a variable location between the first end and second end;

the location float comprising a redirection element through which the trip line is free to pass through;

wherein the trip line and ballast weight are configured such that the ballast weight hangs under the location float at a location suspended above the seabed surface to exert a downward force on the location float; and wherein the trip line float assembly is configured such that the location float at least partially submerges below a surface of the body of water when the anchor is translating in a direction transverse to the seabed surface to indicate a non-set condition of the anchor.

10. The apparatus of claim 9, wherein one or more of a mass of the ballast weight and volume of the location float are sized so that at least a portion of the location float remains elevated above the water surface when the anchor is in a set or stationary position on the seabed surface, yet becomes submerged under the water surface when the anchor is translating or moving in relation to the seabed surface.

11. The apparatus of claim 9, wherein the trip line has a maximum length of twice a depth from the water surface to the seabed surface, and a minimum length equal to said depth.

12. The apparatus of claim 9, wherein the redirection element comprises a pulley.

13. The anchor setting system of claim 9, wherein the redirection element comprises a loop.

14. The anchor setting system of claim 12, wherein the redirection element is disposed at a bottom location of the location float.

15. The apparatus of claim 9:

wherein the trip line has a length such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

16. A method for setting an anchor for a vessel in a body of water, comprising:

coupling a first end of a trip line to a ballast weight and a second end of the trip line to an anchor, the anchor configured for engaging with a seabed surface of the body of water, the anchor coupled to the vessel via an anchor rode;

wherein a location float is coupled to the trip line at a variable location between the first end and second end and comprising a redirection element through which the trip line is free to pass through;

dropping the anchor and trip line into the body of water such that the anchor sinks to contact the seabed surface;

suspending the ballast weight below the location float at a location above the seabed surface to exert a downward force on the location float; and moving the vessel to cause translation of the anchor in a direction transverse to the seabed surface, such motion of the anchor changing one or more of angular orientation or force acting on the trip line to cause the location float to at least partially submerge below a surface of the body of water to indicate a non-set condition of the anchor.

17. The method of claim 16, further comprising:

engaging the anchor with a seabed surface such that motion of the anchor with respect to the seabed surface is ceased; and wherein cessation of motion of said anchor allows the location float to return to the water surface to indicate that the anchor has been set.

18. The method of claim 16, further comprising:

sizing one or more of a mass of the ballast weight and volume of the location float so that at least a portion of the location float remains elevated above the water surface when the anchor is in a set or stationary position on the seabed surface, yet becomes submerged under the water surface when the anchor is translating or moving in relation to the seabed surface.

19. The method of claim 16, further comprising:

setting a length of the trip line such that it forms a descending portion between the ballast weight and the redirection element and an ascending portion between the redirection element and the anchor when the anchor is in contact with the seabed surface; and wherein the ascending portion forms a deflection angle $\alpha$ with respect to vertical, the deflection angle being at or near 0° when the anchor is at rest or set with respect to the seabed surface and greater than 0° or increasing when the anchor is translating with respect to the seabed surface.

20. The method of claim 16, wherein the trip line is sized to have a maximum length of twice a depth from the water surface to the seabed surface, and a minimum length equal to said depth.

* * * * *